US008544186B2

(12) United States Patent
Hsu

(10) Patent No.: US 8,544,186 B2
(45) Date of Patent: Oct. 1, 2013

(54) HAND DRYER WITH ANNULAR AIR EXHAUST

(75) Inventor: Chi-Chin Hsu, New Taipei (TW)

(73) Assignee: Hokwang Industries Co., Ltd., New Taipei (TW)

( * ) Notice: Subject to any disclaimer, the term of this patent is extended or adjusted under 35 U.S.C. 154(b) by 232 days.

(21) Appl. No.: 13/105,292

(22) Filed: May 11, 2011

(65) Prior Publication Data

US 2012/0285033 A1 Nov. 15, 2012

(51) Int. Cl.
*F26B 19/00* (2006.01)

(52) U.S. Cl.
USPC ..... 34/202; 34/218; 34/233; 34/529

(58) Field of Classification Search
USPC ..... D28/54.1, 12, 58; 34/266, 201, 202, 34/385, 529, 218, 233; D23/457, 385; 392/381, 380
See application file for complete search history.

(56) References Cited

U.S. PATENT DOCUMENTS

| | | | | | |
|---|---|---|---|---|---|
| 2,490,019 | A | * | 12/1949 | Elliot | 34/202 |
| 3,643,346 | A | * | 2/1972 | Lester | 34/202 |
| 4,398,310 | A | * | 8/1983 | Lienhard | 4/623 |
| 5,099,587 | A | * | 3/1992 | Jarosch | 34/202 |
| 5,146,695 | A | * | 9/1992 | Yang | 34/90 |
| 5,459,944 | A | * | 10/1995 | Tatsutani et al. | 34/202 |
| 6,148,539 | A | * | 11/2000 | Hatfield et al. | 34/223 |
| 6,185,838 | B1 | * | 2/2001 | Moore | 34/202 |
| 6,189,230 | B1 | * | 2/2001 | Huen | 34/90 |
| D451,247 | S | * | 11/2001 | Khalaj | D28/54.1 |
| D483,152 | S | * | 12/2003 | Martinuzzo et al. | D28/54.1 |
| 6,769,197 | B1 | * | 8/2004 | Tai | 34/90 |
| D542,474 | S | * | 5/2007 | Churchill et al. | D28/54.1 |
| D548,399 | S | * | 8/2007 | Nikaido et al. | D28/54.1 |
| 7,437,833 | B2 | * | 10/2008 | Sato et al. | 34/90 |
| 7,555,209 | B2 | | 6/2009 | Pradas Diez et al. | |
| 7,596,883 | B2 | * | 10/2009 | Kameishi | 34/90 |
| 7,614,160 | B2 | * | 11/2009 | Kameishi et al. | 34/90 |
| 7,657,162 | B2 | * | 2/2010 | Itoigawa et al. | 392/384 |
| 7,774,953 | B1 | * | 8/2010 | Duran | 34/77 |
| 7,856,736 | B2 | * | 12/2010 | Churchill et al. | 34/90 |
| 7,946,055 | B2 | * | 5/2011 | Churchill et al. | 34/80 |
| D652,171 | S | * | 1/2012 | Choi | D28/54.1 |

(Continued)

FOREIGN PATENT DOCUMENTS

| | | | |
|---|---|---|---|
| KR | 101080174 | B1 * | 10/2010 |
| KR | 20120070020 | A * | 10/2010 |

(Continued)

*Primary Examiner* — Jiping Lu
(74) *Attorney, Agent, or Firm* — Muncy, Geissler, Olds & Lowe, PLLC

(57) ABSTRACT

A hand dryer with annular air exhaust includes a casing and an air supply device located in the casing. The casing has a coupling portion and an air exhaust portion connected to the coupling portion. The air exhaust portion has two extension sections extended from the coupling portion and a connection section connected to the two extension sections to form an annular hand drying passage. The air exhaust portion includes a plurality of first nozzles and a plurality of second nozzles corresponding to the hand drying passage which has a first opening and a second opening at two ends. The air supply device has an airflow guiding duct to direct air to the air exhaust portion. The first and second nozzles exhaust the air towards the hand drying passage to form annular air exhaust, and thus hand drying angles are increased to dry hands faster.

8 Claims, 5 Drawing Sheets

(56) References Cited

U.S. PATENT DOCUMENTS

| | | | | |
|---|---|---|---|---|
| 8,112,899 | B1 * | 2/2012 | Duckworth | 34/202 |
| 8,155,508 | B2 * | 4/2012 | Caine et al. | 392/380 |
| D661,022 | S * | 5/2012 | Huang et al. | D28/54.1 |
| D664,299 | S * | 7/2012 | Ishida | D28/54.1 |
| D668,388 | S * | 10/2012 | Hsu | D28/54.1 |
| 8,347,521 | B2 * | 1/2013 | Churchill et al. | 34/82 |
| 2007/0263994 | A1 * | 11/2007 | Diez et al. | 392/380 |
| 2008/0209760 | A1 * | 9/2008 | French et al. | 34/585 |
| 2008/0216342 | A1 * | 9/2008 | Kameishi et al. | 34/202 |
| 2008/0216344 | A1 * | 9/2008 | Churchill et al. | 34/202 |
| 2008/0222910 | A1 * | 9/2008 | Churchill et al. | 34/202 |
| 2008/0256825 | A1 * | 10/2008 | Hsu | 34/529 |
| 2008/0263889 | A1 * | 10/2008 | Fukaya et al. | 34/267 |
| 2008/0301970 | A1 * | 12/2008 | Hackwell et al. | 34/202 |
| 2008/0313918 | A1 * | 12/2008 | Dyson et al. | 34/202 |
| 2008/0313919 | A1 * | 12/2008 | Churchill et al. | 34/202 |
| 2008/0317448 | A1 * | 12/2008 | Brown et al. | 392/380 |
| 2009/0034946 | A1 * | 2/2009 | Caine et al. | 392/380 |
| 2009/0113746 | A1 * | 5/2009 | Churchill et al. | 34/202 |
| 2011/0277342 | A1 * | 11/2011 | Ishii et al. | 34/526 |

FOREIGN PATENT DOCUMENTS

| | | | |
|---|---|---|---|
| TW | 579813 | | 3/2004 |
| TW | M357271 | | 5/2009 |
| WO | WO-2007/020699 | A1 | 2/2007 |
| WO | WO2012175860 | * | 6/2011 |

* cited by examiner

HAND DRYER WITH ANNULAR AIR EXHAUST

FIELD OF THE INVENTION

The present invention relates to a hand dryer with annular air exhaust and particularly to a hand dryer that generates annular airflow to wrap around user's hands.

BACKGROUND OF THE INVENTION

With people's increasing demand for life quality, hygiene also becomes an important issue in their daily living, this is especially obvious to public sanitary facilities. In the past, many public sanitary facilities must be operated manually by users. Continuous progress has been developed these years that sensors have been deployed to automatically detect user's using conditions. Formerly after the user has finished hand washing, water remained on the hands could drop around, thus paper towel has been produced to dry hands after washing. However, with increasing awareness of environmental protection and preservation, trees become precious resource. As a result, using hand dryers to replace paper towel gradually becomes a trend.

At present, there are myriad types of hand dryers on the market. The hand drying principle is mainly to use a motor which rotates the blades to suck the air in, heat the air and then exhaust the heated air to dry user's hands. For instance, R.O.C. patent Nos. M357271 and 579813 respectively disclose a hand dryer that has an air outlet on the exterior to exhaust air to dry user's hands. The hand dryer has only one air outlet to exhaust the air in one direction, and hence it cannot dry user's hands quickly. Moreover, the air exhaust range of the air outlet is too small and air exhaust volume is limited, and hence a greater amount of electric power has to be consumed to fully dry the hands.

U.S. Pat. No. 7,555,209 and WO 2007/020699 respectively disclose a hand dryer that has multiple air outlets at two corresponding sides of the hand drying area to form a bidirectional air exhaust structure to increase the hand drying area. The bidirectional air exhaust structure exhausts the air to dry user's palms and backs of hands at the same time. While such a design increases the number of the air outlets and exhausts the air bidirectionally to increase the hand drying area and save hand drying time to overcome the problems in the conventional hand dryer with single air outlet and unidirectional air exhaust, it still has drawbacks in use. The airflow generated by the bidirectional air exhaust hand dryer can blow merely two opposite sides of user's hands but not all-round airflow. User's hands have to be moved slowly up and down during drying; however, even if the palms and backs of the hands have been dried, hand crevices, such as finger gaps and finger nails could still be wet. To fully dry the hands is desired, user has to constantly and slowly move the hands up and down.

SUMMARY OF THE INVENTION

The primary object of the present invention is to solve the problem of the conventional hand dryers of deficient air exhaust directions that cannot rapidly dry the hands.

To achieve the foregoing object, the invention provides a hand dryer with annular air exhaust. The hand dryer includes a casing and an air supply device. The casing has a coupling portion and an air exhaust portion connected to the coupling portion. The air exhaust portion has two extension sections extended from the coupling portion and a connection section connected to the two extension sections to form an annular hand drying passage. The air exhaust portion also has a plurality of nozzles corresponding to the hand drying passage and a first opening and a second opening at two ends of the hand drying passage. The air supply device is located in the coupling portion and has an airflow guiding duct to direct air to the air exhaust portion. The nozzles exhaust the air towards the hand drying passage to form annular air exhaust.

In an embodiment of the invention, the casing includes a front half shell and a rear half shell coupled to the front half shell. The first opening and second opening are located respectively on the front half shell and rear half shell. The coupling portion is formed at a thickness greater than that of the air exhaust portion, and thus a drop height section is formed between the coupling portion and the air exhaust portion on the rear half shell. The air supply device includes a blower connected to the airflow guiding duct which has two first guiding portions located on the two extension sections and two second guiding portions extended from the first channels to the connection section. The nozzles are connected to the airflow guiding duct and are formed inclinedly along a direction from the first opening towards the second opening to exhaust the air obliquely.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
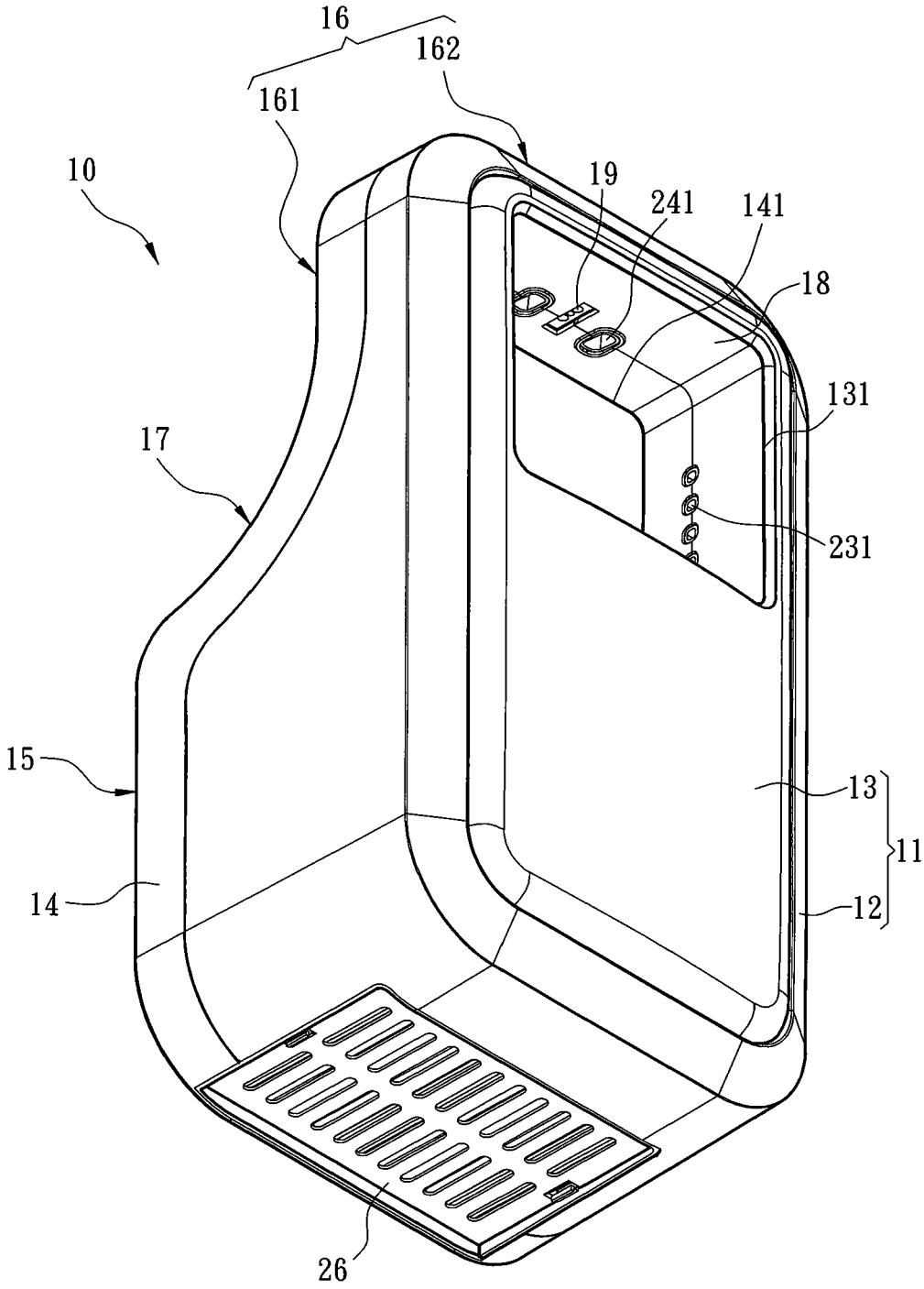
FIG. 1 is a perspective view of the invention.
Figure 2:
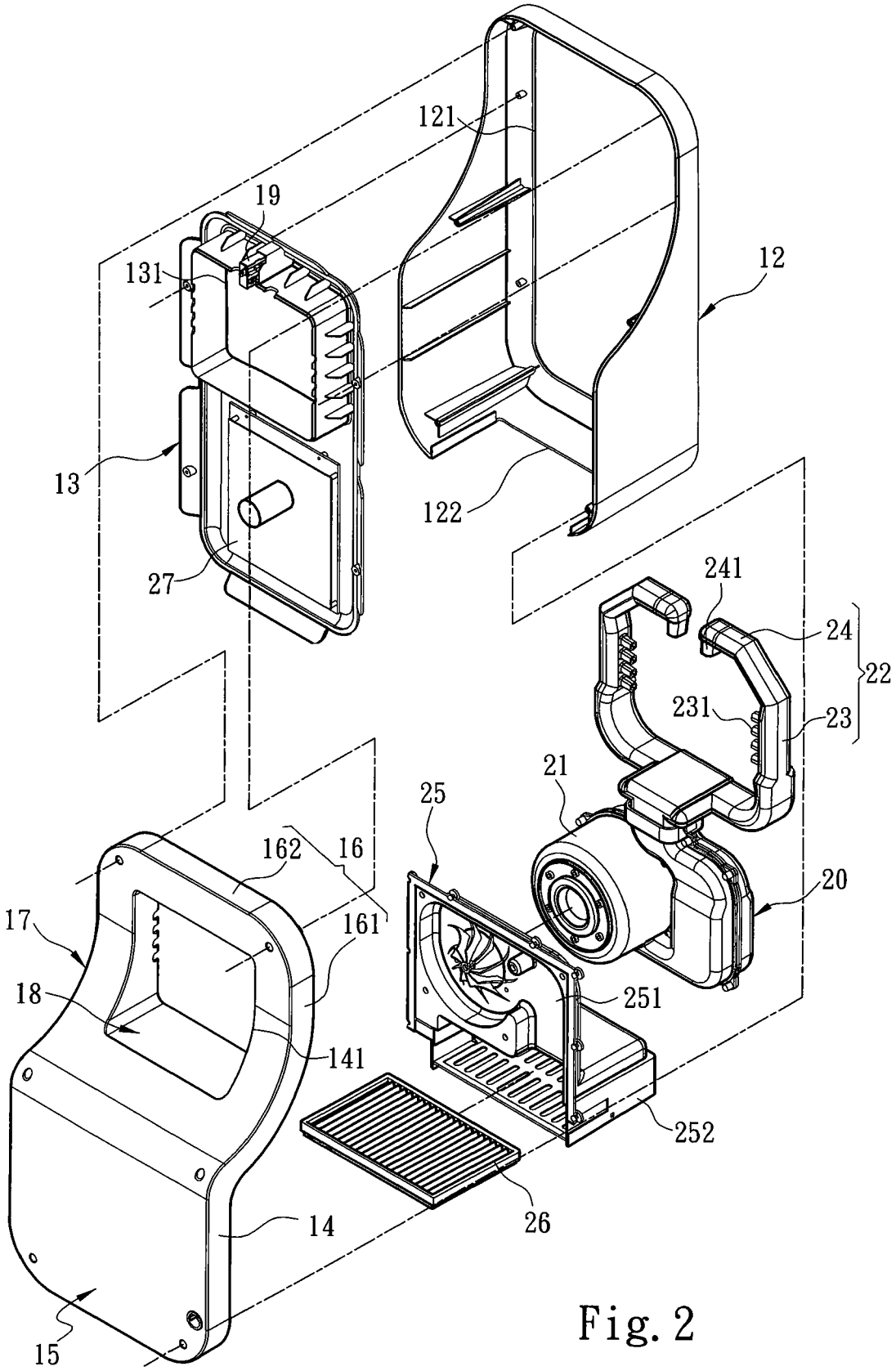
FIG. 2 is an exploded view of the invention.

Please refer to FIGS. 1 and 2, the present invention aims to provide a hand dryer with annular air exhaust. The hand dryer mainly includes a casing 10 and an air supply device 20 located in the casing 10. The casing 10 includes a front half shell 11 and a rear half shell 14 coupled to the front half shell 11. The front half shell 11 has a side frame 12 and a front panel 13. The side frame 12 has one side connected to the rear half shell 14 and another side formed a fastening opening 121 to hold the front panel 13. The casing 10 further has a coupling portion 15 and an air exhaust portion 16 connected to the coupling portion 15. The coupling portion 15 is formed at a thickness greater than that of the air exhaust portion 16, and thus a drop height section 17 is formed between the coupling portion 15 and the air exhaust portion 16 on the rear half shell 14. The air exhaust portion 16 has two extension sections 161 extended from the coupling portion 15 and a connection section 162 connected to the two extension sections 161. Through the connection section 162, two extension sections 161 and coupling portion 15, an annular hand drying passage 18 is formed. The hand drying passage 18 has two ends formed respectively a first opening 131 on the front panel 13 of the front half shell 11 and a second opening 141 on the rear half shell 14. In addition, the casing 10 also has an infrared sensor 19 located on the connection section 162 and an air inlet 122 below the side frame 12.

Figure 3:
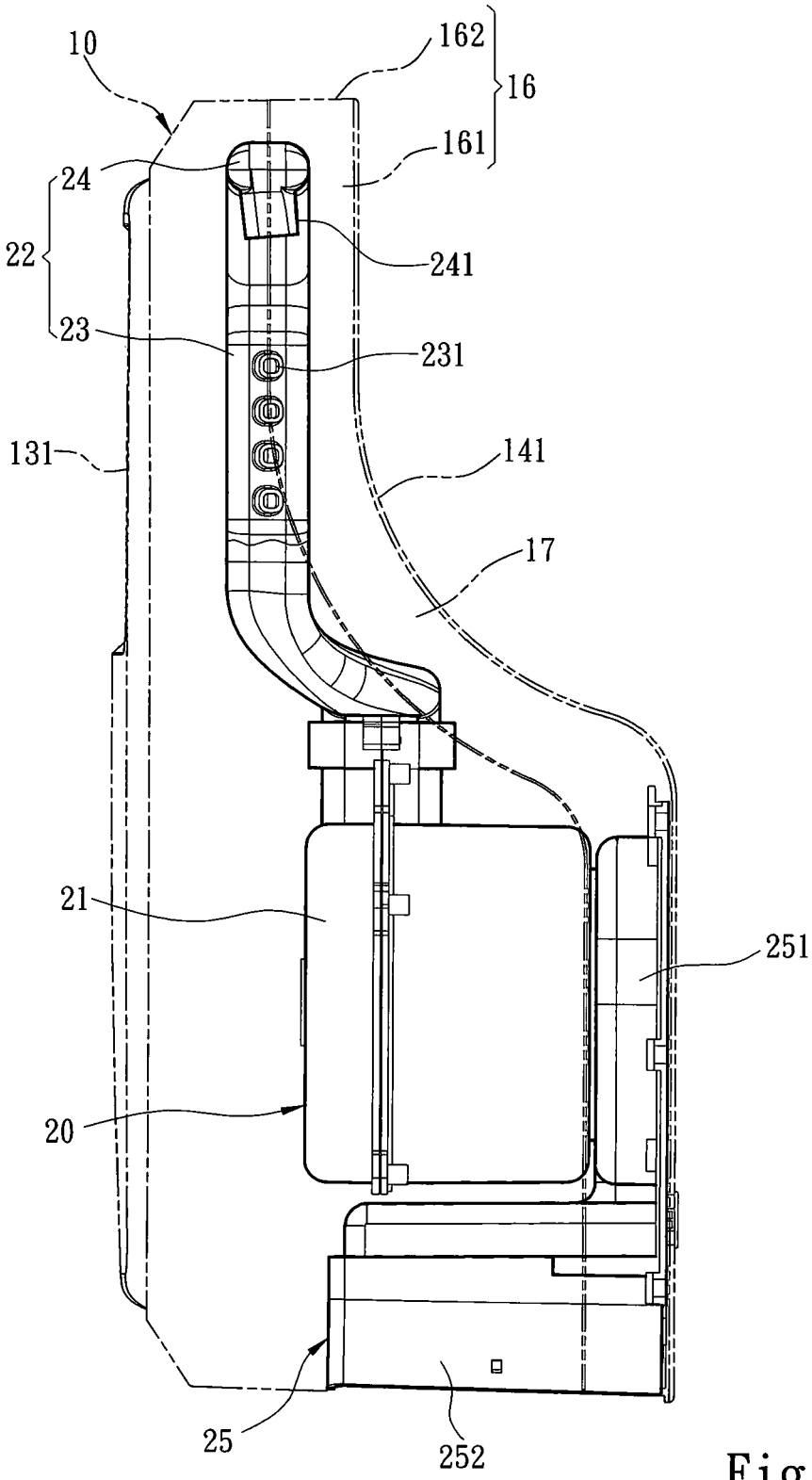
FIG. 3 is a sectional view of the invention.

The air supply device 20 is located in the coupling portion 15 and mainly includes a blower 21 and an airflow guiding duct 22 coupled to the blower 21. The blower 21 is connected to an airflow guiding member 25 which has an airflow channel 251 and an anchor portion 252 located on the air inlet 122. The anchor portion 252 communicates with the airflow channel 251 and has a heating device 26 installed thereon. The blower 21 is coupled with a circuit board 27 to control activation timing of the blower 21. When the blower 21 is activated, external air is introduced through the air inlet 122 into the heating device 26 and heated to higher temperature, and then the heated air is directed through the airflow channel 251 into the blower 21. Also referring to FIG. 3, the airflow guiding duct 22 includes two first guiding portions 23 located in the two extension sections 161 and two second guiding portions 24 extended from the first guiding portions 23 into the connection section 162. The first and second guiding portions 23 and 24 have respectively a plurality of first nozzles 231 and second nozzles 241 passing through the air exhaust portion 16. The blower 21, through the first and second guiding portions 23 and 24, directs the air to the extension sections 161 and connection section 162, and the first and second nozzles 231 and 241 exhaust air towards the hand drying passage 18 to form annular air exhaust, and thus the main structure of the invention is formed.

In an embodiment of the invention, the first and second nozzles 231 and 241 are formed inclinedly along the direction from the first opening 131 towards the second opening 141 to exhaust the air obliquely.

Figure 4:
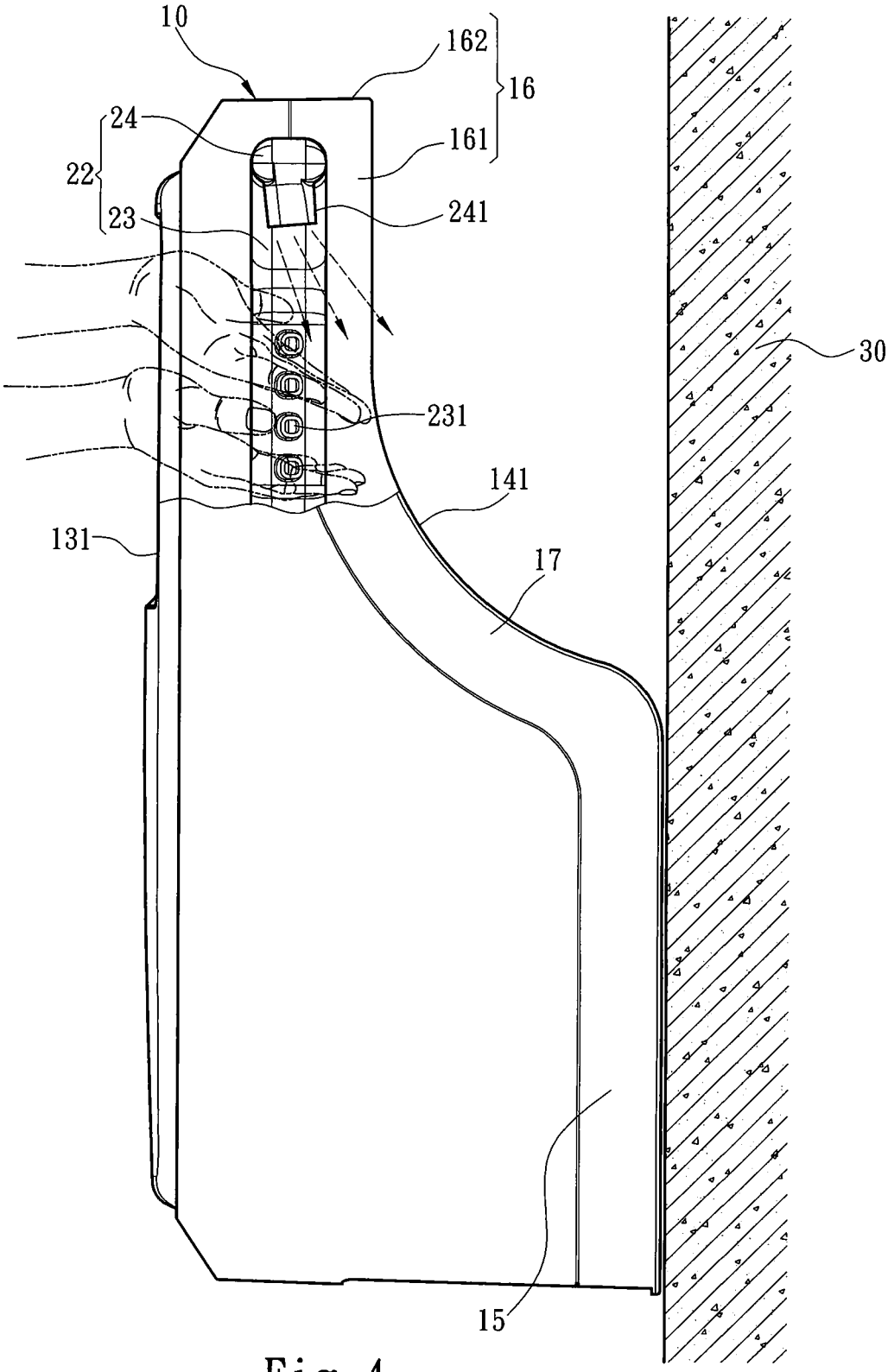
FIG. 4 is a schematic view of the invention in a use condition.
Figure 5:
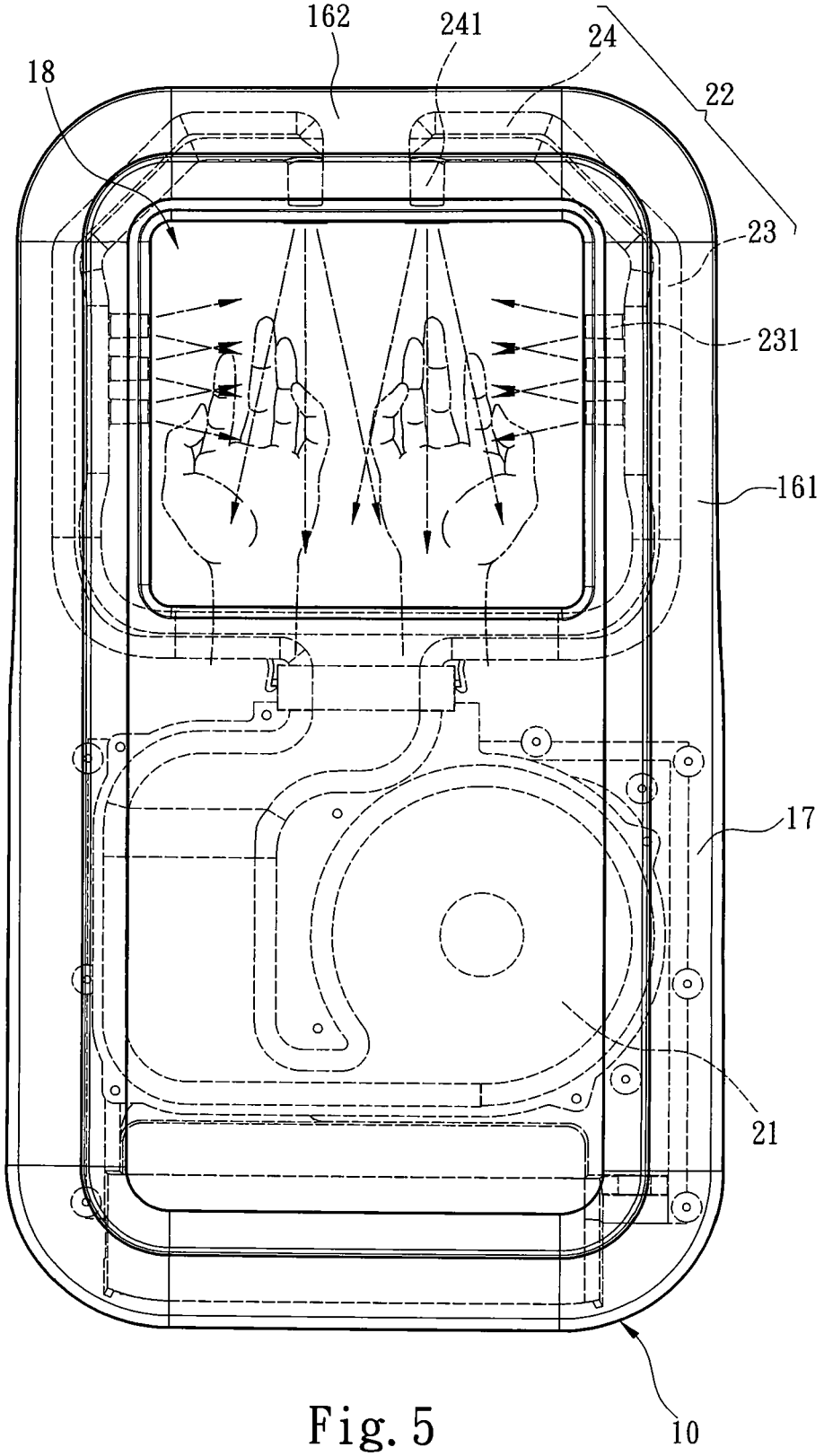
FIG. 5 is a schematic view of the invention in another use condition.

Referring to FIGS. 4 and 5, since the thickness of the coupling portion 15 is greater than that of the air exhaust portion 16 and the drop height section 17 is formed between the coupling portion 15 and air exhaust portion 16 on the rear half shell 14, when the hand dryer is mounted onto a wall 30 through the coupling portion 15, a gap is formed between the air exhaust portion 16 and the wall 30. When the hand dryer is in use for drying hands of the user, the hands are entered into the hand drying passage 18 via the first opening 131 and removed outside via the second opening 141, and thus a greater hand drying range can be obtained. Moreover, through the two extension sections 161 and connection section 162 forming the annular air exhaust, the hands can evenly receive the air to achieve faster drying. In addition, as the first and second nozzles 231 and 241 are formed inclinedly along the direction from the first opening 131 towards the second opening 141, water and moisture remained on the hands can be carried away along the airflow direction towards the second opening 141 to be exhausted during drying without spraying to the user.

As a conclusion, the hand dryer of the invention mainly includes a casing 10 with a coupling portion 15 and an air exhaust portion 16 formed thereon. The air exhaust portion 16 has two extension sections 161 extended from the coupling portion 15 and a connection section 162 connected to the two extension sections 161 to form an annular hand drying passage 18. The hand drying passage 18 has a first opening 131 and a second opening 141 formed at two ends. The air supply device 20 directs the air through an airflow guiding duct 22 to the air exhaust portion 16 and exhausts the air towards the hand drying passage 18 to form annular air exhaust. The hand dryer thus formed increases air exhaust directions so that user's hands can evenly receive airflow to be dried faster.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A hand dryer with annular air exhaust, comprising:

a casing which includes a coupling portion fastened to a wall and an air exhaust portion extended from and connected to the coupling portion, the coupling portion being formed at a thickness greater than that of the air exhaust portion to form a drop height section between them such that a moisture evaporation space is formed between the wall and the air exhaust portion, the air exhaust portion including two extension sections extended from the drop height section and a connection section connected to the two extension sections to form an annular hand drying passage communicating with the moisture evaporation space, the air exhaust portion further including a plurality of first nozzles located at the two extension sections and a plurality of second nozzles located at the connection section that are corresponding to the hand drying passage, the hand drying passage including a first opening and a second opening facing the moisture evaporation space at two ends thereof; and an air supply device which is located in the coupling portion and includes an airflow guiding duct to direct air to the air exhaust portion, the first and second nozzles exhausting the air towards the hand drying passage such that moisture from a user's hands is blown into the moisture evaporation space in an air flowing direction for evaporation.

2. The hand dryer of claim 1, wherein the casing includes a front half shell and a rear half shell coupled to the front half shell, the first opening being located on the front half shell and the second opening being located on the rear half shell.

3. The hand dryer of claim 2, wherein the front half shell includes a side frame and a front panel, the side frame including one side connected to the rear half shell and another side formed a fastening opening to hold the front panel.

4. The hand dryer of claim 1, wherein the first and second nozzles are connected to the airflow guiding duct and formed inclinedly along a direction from the first opening towards the second opening.

5. The hand dryer of claim 1, wherein the airflow guiding duct includes two first guiding portions located in the two extension sections and two second guiding portions extended from the first guiding portions into the connection section.

6. The hand dryer of claim 1, wherein the air supply device includes a blower connected to the airflow guiding duct.

7. The hand dryer of claim 6, wherein the blower includes an airflow guiding member which includes an airflow channel and an anchor portion communicating with the airflow channel, the anchor portion including a heating device corresponding to an air inlet of the hand dryer.

8. The hand dryer of claim 1, wherein the air exhaust portion includes an infrared sensor.

* * * * *